United States Patent [19]

Olsen

[11] 4,193,110

[45] Mar. 11, 1980

[54] LIGHT FIXTURES

[75] Inventor: Kolbjørn Olsen, Harstad, Norway

[73] Assignee: Bjørn Kokvik, Oslo, Norway

[21] Appl. No.: 918,031

[22] Filed: Jun. 22, 1978

[51] Int. Cl.[2] ..... F21P 5/00

[52] U.S. Cl. ..... 362/371; 362/363; 362/396; 362/453

[58] Field of Search ..... 362/371, 363, 396, 453

[56] References Cited

U.S. PATENT DOCUMENTS 4,099,224 7/1978 Valpey ..... 362/453

*Primary Examiner*—Stephen J. Lechert, Jr.

*Attorney, Agent, or Firm*—Burns, Doane, Swecker & Mathis

[57] ABSTRACT

A light fixture having securing means for lamp globes, each shaped as two resilient arms, one arm being adapted to engage the globe inside of its opening and the other arm to engage the globe internally, thus locking the arms when the globe is in place.

10 Claims, 5 Drawing Figures

Figure 1:
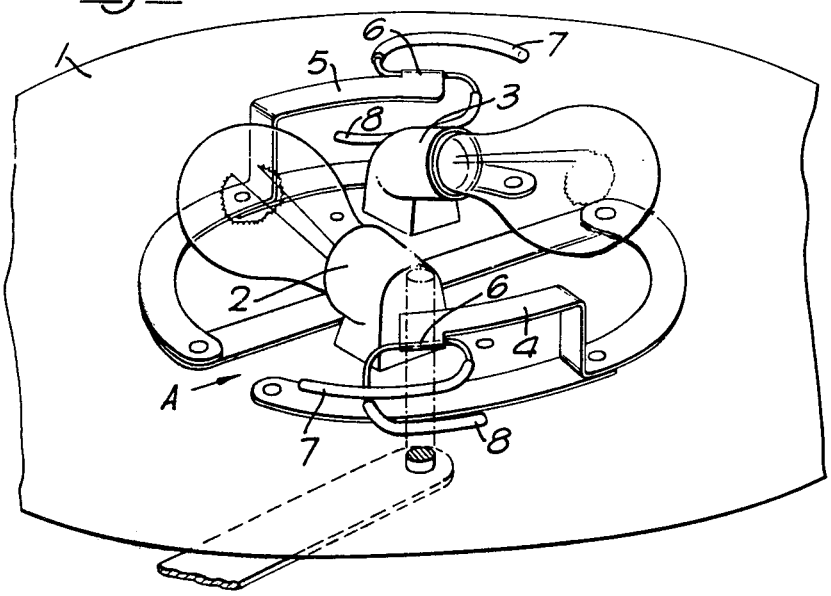

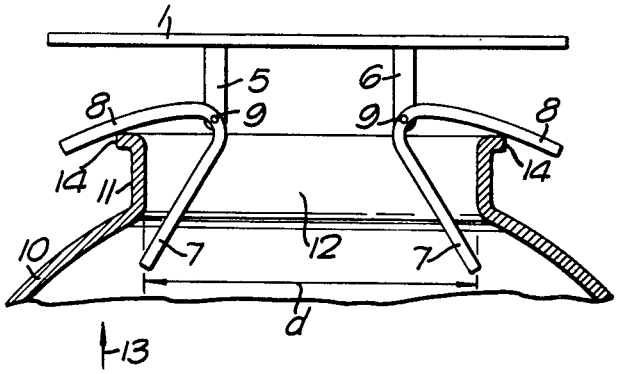
Fig. 2.
Fig. 3.
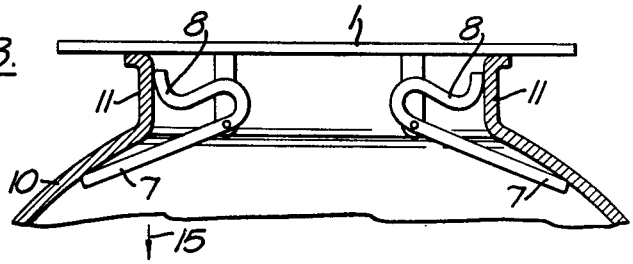
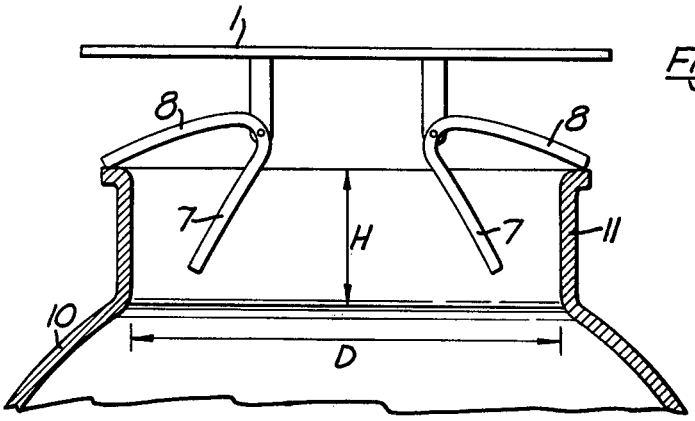
Fig. 4.
Fig. 5.
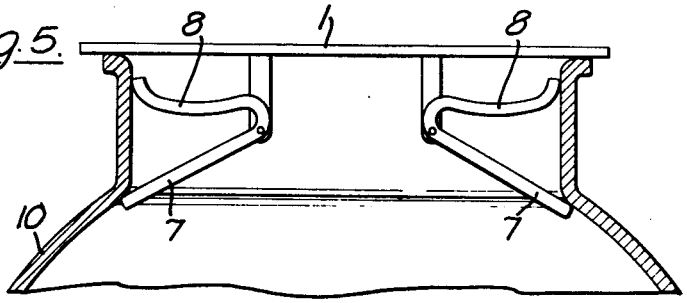

LIGHT FIXTURES

The present invention relates to an improvement in light fixtures with securing means for lamp globes.

There are previously known a large number of designs for fixtures adapted to carry lamp globes of all kinds. The linkages serving to secure the globe suffer from the disadvantage that they have to be operated differently, according to their construction, which also may be so that fixture of one size only will receive lamp globes of one particular size and shape. The result is that for different designs of lamp globes, designs perhaps dictated by fashion, it will be necessary to manufacture a large number of different fixtures which most likely must be in store for a long time.

The purpose of the present invention is for this reason to provide an improvement in light fixtures enabling positioning of a lamp globe by a simple pushing motion and the fixture shall permit mounting not only of lamp globes having openings varying within wide limits, but also lamp globes with necks around the opening, designed differently.

It will then be possible to reduce the number of models of fixtures for lamps to a substantial degree thus simplifying manufacture and storage, and designers will more easily than previously be able to design lamp globes for different purposes.

In accordance with the invention this is achieved by providing the light fixture with resilient securing means by a simple displacement of the lamp globe clamps, tightens and locks the lamp globe in place.

The resiliency of the securing means enables same to adapt to very different shapes and sizes of the neck and its opening on the lamp globe.

The invention is characterized in the features claimed in the claims, and it will be described more in detail with reference to the drawing on which:

FIG. 1 is a perspective view of a light fixture constructed in accordance with the invention, FIG. 2 shows the operation of the invention at the moment a lamp globe is pushed in place, FIG. 3 is a view corresponding to FIG. 2, but with the lamp globe in locked position, FIGS. 4 and 5 are views corresponding to FIGS. 2 and 3, but showing another size and design of the neck of the lamp globe.

In the example shown on FIG. 1, the fixture comprises a disc 1 provided with bulb sockets 2, 3 of usual design. Two brackets 4, 5 support the securing means according to the invention, said means being in the form of a pivotable resilient member supported at 6, and having an upper arm 7 and a lower arm 8. The part comprising the arms 7 and 8 are shown made from resilient wire and the arms 7 and 8 are shaped and dimensioned as described more in detail below. On FIGS. 2 and 3 the light fixture is very simplified, bulb sockets and other components being deleted to simplify the understanding of the invention. The disc 1 of the fixture also has brackets 5 and 6 which may be made in any suitable way as long as the brackets form a pivot 9 for the movable resilient member with the arms 7, 8. On FIG. 2 a lamp globe 10 is shown having a neck 11 and an opening 12, the inner diameter d of which for example being 60 mm. When the lamp globe 10 is to be placed on the light fixture, the globe is pushed on to said fixture in the direction shown with the arrow 13. The edge 14 of the neck will then abut the arms 8 and pivot the movable members about the pivots 9 thus bringing the arms 7 closer to the inside of the lamp globe 10. As the lamp globe 10 is getting closer to the final position the resilient spring light arms 8 will snap into the neck 11 by being elastically deformed and they will adapt themselves to be inside the neck. This is the situation of FIG. 3. By having the arms 8 abutting the interior of the neck 11, the possibility of movement of the arms 7 and 8 are eliminated and the arms 7 will—as shown on FIG. 3—thereby hold the lamp globe in position with an suitable force, a force which can be adjusted by the stiffness and resiliency of the arm 7 and 8. The holding force should of course be as large as possible, but not larger than an ordinary person, without exerting too much effort can pull the lamp globe off by moving the globe in the direction shown by the arrow 15, after the locking arm of the fixture is moved so that the arm 8 of the securing spring is released from the globe. FIGS. 4 and 5 are not to be described in detail, but are included to show that the same fixture as on FIGS. 2 and 3 can be used for a lamp globe when the neck 11 is of another shape and size than the neck 11 on FIGS. 2 and 3. The diameter D of the interior of the globe 10 on FIG. 4 can be 75 mm, and the height H of the neck 11 is also larger than the corresponding dimension on FIGS. 2 and 3. However, the mode of operation is the same, as the arms 8 by their engagement with the edge of the neck 11 pivot the arms 7 into the lamp globe, which thereby is locked in place when the arms 8 snap into the neck 11 and are supported against same to lock the arms 7, so that these arms cannot be moved unless the holding force of the fixture is overcome manually.

The example shown will only serve to illustrate the invention and its operation and does not limit the protection offered by this patent.

The mode of operation of the fixture will be the same as explained above, also for lamp globes having no neck, for example a spherical globe with a suitable opening.

Having described my invention, I claim:

1. In a light fixture having securing means for a lamp globe, the improvement comprising at least two moveable members each having a first resilient arm which abuts the inside of the lamp globe in the area around an opening of the lamp globe, and a second resilient arm which abuts the inside of the opening of the lamp globe to releasably maintain the first arm in said abutment with the inside of the lamp globe whereby the lamp globe may be releasably secured to the light fixture.

2. The improvement according to claim 1, wherein the moveable members are of resilient wire.

3. The improvement according to claim 1, wherein each of the moveable members is pivotably attached to the light fixture with the first and second arms connected to one another by a resilient member whereby said moveable members may releasably secure lamp globes having openings of different size.

4. A light fixture, comprising:

a base member;

a lamp globe having an opening;

means for releasably securing said lamp globe to said base member including, first and second members each including a first resilient arm and a second resilient arm, the first resilient arm being spaced away from the second resilient arm, and means for pivotably mounting each of said first and second members on said base member, said first and second members each being pivotable about a portion intermediate of said first and second resilient arms.

5. The light fixture of claim 4 wherein the first and second members are of resilient wire.

6. The light fixture of claim 4 wherein said first resilient arm abuts the inside of the lamp globe and the second resilient arm abuts the lamp globe substantially at the opening of the lamp globe when the lamp globe is releasably secured to the base member.

7. A light fixture, comprising:

a base member;

means for releasably securing a lamp globe to said base member including, first and second members each including a first resilient arm and a second resilient arm, the first resilient arm being spaced away from the second resilient arm, and means for movably mounting each of said first and second members on said base member, said first and second members each being moveable about a portion intermediate of said first and second resilient arms.

8. The light fixture of claim 7 wherein the first and second members are of resilient wire.

9. The light fixture of claim 8 wherein the portion intermediate said first and second resilient arms is resilient whereby the spacing between said first and second arms may be adjusted.

10. The light fixture of claim 7 wherein the first and second members are each pivotable with respect to the base member.

* * * * *